US006868662B2

(12) United States Patent
Rodgers

(10) Patent No.: US 6,868,662 B2
(45) Date of Patent: Mar. 22, 2005

(54) ENTANGLED BICOMPONENT YARN AND PROCESS TO MAKE THE SAME

(75) Inventor: John A. Rodgers, Dayton, TN (US)

(73) Assignee: Invista North America S.a.r.l., Wilmington, DE (US)

( * ) Notice: Subject to any disclaimer, the term of this patent is extended or adjusted under 35 U.S.C. 154(b) by 156 days.

(21) Appl. No.: 10/294,345

(22) Filed: Nov. 14, 2002

(65) Prior Publication Data

US 2004/0093845 A1 May 20, 2004

(51) Int. Cl.[7] ..... D02G 3/02; D01G 3/22

(52) U.S. Cl. ..... 57/246

(58) Field of Search ..... 57/243–247; 28/247, 28/271, 276; 428/364

(56) References Cited

U.S. PATENT DOCUMENTS

| | | | | |
|---|---|---|---|---|
| 2,985,995 A | | 5/1961 | Bunting, Jr. et al. | |
| 3,115,691 A | | 12/1963 | Bunting, Jr. et al. | |
| 3,671,379 A | | 6/1972 | Evans et al. | |
| 3,948,033 A | | 4/1976 | Henstock et al. | |
| 4,100,725 A | | 7/1978 | Magel | |
| 5,195,313 A | * | 3/1993 | Coons, III | 57/264 |
| 5,763,076 A | * | 6/1998 | Coons et al. | 428/364 |
| 6,052,878 A | * | 4/2000 | Allred et al. | 28/274 |
| 6,306,499 B1 | * | 10/2001 | Ochi et al. | 428/364 |
| 6,689,461 B2 | * | 2/2004 | Koyanagi et al. | 428/364 |
| 2001/0055683 A1 | | 12/2001 | Ochi et al. | |
| 2002/0025433 A1 | | 2/2002 | Chang et al. | |

FOREIGN PATENT DOCUMENTS

| | | |
|---|---|---|
| EP | 1 059 372 A1 | 12/2000 |
| WO | WO 02/38847 A1 | 5/2002 |
| WO | WO 02/063080 A1 | 8/2002 |

* cited by examiner

*Primary Examiner*—John J. Calvert
*Assistant Examiner*—Shaun R Hurley
(74) *Attorney, Agent, or Firm*—Robert B. Furr, Jr.

(57) ABSTRACT

The invention provides an entangled continuous filament yarn comprising at least two bicomponent filaments each comprising poly(trimethylene terephthalate) and poly (ethylene terephthalate), wherein the entangled yarn has a node frequency of about 40 to 50 nodes/m, a Crimp Potential of at least about 40%, substantially no twist, and a standard deviation of intervals between nodes of no more than about 1.1 cm. The invention further provides a process for making such an entangled yarn.

15 Claims, 2 Drawing Sheets

ENTANGLED BICOMPONENT YARN AND PROCESS TO MAKE THE SAME

BACKGROUND OF THE INVENTION

1. Field of the Invention

This invention relates to polyester bicomponent continuous filaments, more particularly to yarns of such filaments which have high crimp level, high node frequency and node interval constancy, and to a process for making such yarns.

2. Description of Background Art

Continuous bicomponent filaments and yarns of poly (ethylene terephthalate) and poly(trimethylene terephthalate) have been disclosed in U.S. Pat. No. 3,617,379 and Published Applications US2002/0025433, US2001/0055683, and WO02/063080. However, such yarns can be too nonuniform or twist-lively to perform well in downstream processing.

U.S. Pat. Nos. 2,985,995 and 3,115,695 describe jets that can be used to entangle 'flat' fibers, and U.S. Pat. No. 4,100,725 discloses tightly entangled yarns with long entanglement nodes, but such yarns can have inadequate stretch properties.

Polyester bicomponent yarns having high crimp levels, little or no twist, and frequent entanglement nodes at highly constant intervals are still needed, as is a process to make them.

SUMMARY OF THE INVENTION

The present invention provides an entangled continuous filament yarn comprising at least two bicomponent filaments each comprising poly(trimethylene terephthalate) and poly (ethylene terephthalate), wherein the entangled yarn has a node frequency of about 40 to 50 nodes/m, a Crimp Potential of at least about 40%, substantially no twist, and a standard deviation of intervals between nodes of no more than about 1.1 cm.

The invention provides, in a first process aspect, a process for making an entangled yarn comprising the steps of:

providing at least two bicomponent continuous filaments each comprising poly(trimethylene terephthalate) and poly (ethylene terephthalate) and having a Crimp Potential of at least about 40%, wherein the filaments are selected from the group consisting of fully drawn and fully oriented;

countercurrently contacting said filaments with a fluid at an overfeed of about 2 to 6% to entangle the yarn.

The invention also provides, in a second process aspect, a process for making such a yarn comprising the steps of providing at least two bicomponent continuous filaments each comprising poly(trimethylene terephthalate) and poly (ethylene terephthalate) and having a Crimp Potential of at least about 40%, wherein the filaments are selected from the group consisting of fully drawn and fully oriented; providing at least two jets, each jet comprising a yarn slot, two channels for directing air at the filaments, a first imaginary plane defined by the channels, and a second imaginary plane perpendicular to the yarn slot, wherein an angle $\gamma$ between the first and second imaginary planes is about −5° to −30°; and passing the filaments through the jets in series at an overfeed of about 2 to 6% to entangle the yarn.

DETAILED DESCRIPTION OF THE INVENTION

Figure 1:
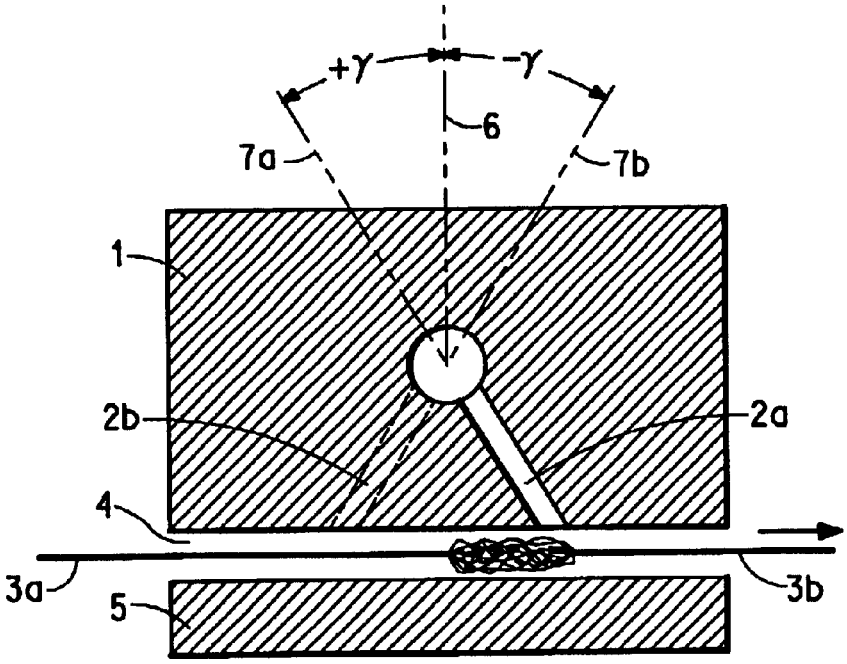
FIG. 1 illustrates in cross-section a jet that can be used in the process of the invention.

It has now been found that bicomponent continuous filament yarns comprising poly(ethylene terephthalate) and poly(trimethylene terephthalate) can be made with high entanglement levels while retaining high crimp levels, a surprising combination. Further, the intervals between nodes in such entangled yarns are very constant, and the yarn also exhibits substantially no twist. Such entangled yarns are useful in making woven and knit fabrics wherever stretch characteristics are desirable, for example in apparel, accessories, upholstery, and the like.

As used herein, "IV" means intrinsic viscosity. "Fully drawn" filament means a bicomponent filament which has been drawn and heat-treated so that it exhibits useful crimp values and is suitable for use without further drawing, for example in weaving, knitting, and the preparation of nonwovens. "Fully oriented" filament means a filament which has been been spun at sufficiently high spinning speed and tension that it requires no drawing or heat-treating to be suitable for use or to exhibit useful crimp values. "Withdrawal speed" means the speed of feed rolls used during fiber spinning, which rolls are positioned between the quench zone and the draw rolls. "Countercurrent" or "countercurrently" means not perpendicular to the direction of yarn travel and not with the direction of yarn travel; in other words: against the direction of yarn travel.

"Bicomponent filament" means a filament comprising poly(ethylene terephthalate) and poly(trimethylene terephthalate) intimately adhered to each other along the length of the filament, so that the filament cross-section is for example a side-by-side, eccentric sheath-core or other suitable cross-section from which useful crimp can be developed. Such filaments are non-elastomeric in that they do not have a break elongation in excess of 100% independent of any crimp. Rather, they rely on spiral crimp for their elasticity, spontaneously developed by thermal treatment of the filaments. Side-by-side filaments subjected to the process of the invention can have a "snowman", oval, or substantially round cross-sectional shape. Eccentric sheath-core fibers can have an oval or substantially round cross-sectional shape. By "substantially round" it is meant that the ratio of the lengths of two axes crossing each other at 90° in the center of the fiber cross-section is no greater than about 1.2:1. By "oval" it is meant that the ratio of the lengths of two axes crossing each other at 90° in the center of the fiber cross-section is greater than about 1.2:1. A "snowman" cross-sectional shape can be described as a side-by-side cross-section having a long axis, short axes substantially perpendicular to the long axis, and at least two maxima in the length of the short axes when plotted against the long axis.

The entangled continuous filament yarn of the invention comprises at least two and typically about 20 to 550 bicomponent filaments. The yarn has a node frequency of about 40 to 50 nodes/m and a Crimp Potential of at least about 40% (typically about 55 to 160%). Typically, the entangled yarn has a Crimp Potential that is reduced by no more than about 25% relative, compared to the Crimp Potential of corresponding unentangled filaments. Further, the intervals between nodes are highly constant, with a standard deviation of no more than about 1.1 cm. The fiber exhibits substantially no twist, meaning less than about one turn/m. When the Crimp Potential is less than about 40% or the node frequency is more than about 50 nodes/m, fabrics made with such a yarn can have inadequate stretch and recovery properties. When the node frequency is less than about 40 nodes/m or when the standard deviation of the interval between nodes is too high, weaving and knitting can become difficult; for example, frequent loom stops can reduce loom efficiency and weaving speed.

The poly(ethylene terephthalate) ("2G-T") and poly (trimethylene terephthalate) ("3G-T") of which the filaments in the yarn of the invention are comprised have different intrinsic viscosities. For example, 2G-T can have an IV of about 0.45–0.80 dl/g and 3G-T can have an IV of about 0.85–1.50 dl/g. The ratio of 2G-T to 3G-T can be about 70:30 to 30:70.

The polyesters in the filaments in the yarn of the invention can be copolyesters, and such copolyesters are included in the meanings of poly(ethylene terephthalate) and poly (trimethylene terephthalate), provided such variants do not have an adverse affect on the amount of crimp in the entangled yarn or on the filaments' processing characteristics. For example, a copoly(ethylene terephthalate) can be used in which the comonomer used to make the copolyester is selected from the group consisting of linear, cyclic, and branched aliphatic dicarboxylic acids having 4–12 carbon atoms (for example butanedioic acid, pentanedioic acid, hexanedioic acid, dodecanedioic acid, and 1,4-cyclohexanedicarboxylic acid); aromatic dicarboxylic acids other than terephthalic acid and having 8–12 carbon atoms (for example isophthalic acid and 2,6-naphthalenedicarboxylic acid); linear, cyclic, and branched aliphatic diols having 3–8 carbon atoms (for example 1,3-propane diol, 1,2-propanediol, 1,4-butanediol, 3-methyl-1,5-pentanediol, 2,2-dimethyl-1,3-propanediol, 2-methyl-1,3-propanediol, and 1,4-cyclohexanediol); and aliphatic and araliphatic ether glycols having 4–10 carbon atoms (for example, hydroquinone bis(2-hydroxyethyl)ether, or a poly(ethyleneether) glycol having a molecular weight below about 460, including diethyleneether glycol). The comonomer can be present in the copolyester at levels of about 0.5–15 mole percent.

Isophthalic acid, pentanedioic acid, hexanedioic acid, 1,3-propane diol, and 1,4-butanediol are preferred because they are readily commercially available and inexpensive.

The copolyester(s) can also contain minor amounts of other comonomers. Such other comonomers include 5-sodium-sulfoisophthalate, at a level of about 0.2–5 mole percent. Very small amounts of trifunctional comonomers, for example trimellitic acid, can be incorporated for viscosity control.

The process of the invention can be used to make an entangled continuous filament yarn that has a node frequency of about 40 to 50 nodes/m and a Crimp Potential of at least about 40% (typically about 55 to 160%). Preferably, the entangled yarn has a Crimp Potential that is reduced by no more than about 25% relative, compared to the Crimp Potential of the filaments as provided (that is, unentangled). Further, operation of the process can make a yarn that has a standard deviation of the interval between nodes of no more than about 1.1 cm.

In the process, at least 2, typically about 20 to 550, continuous bicomponent filaments are provided which are either fully drawn or fully oriented and comprise poly (ethylene terephthalate) and poly(trimethylene terephthalate). The polyesters can be copolymers, as described elsewhere herein. The filaments as provided have a Crimp Potential of at least about 40%.

The process uses at least two jets in series, each supplied with an entangling fluid under pressure. Air is a preferred fluid. Although elevated fluid and jet temperatures can be used to reduce finish deposits on the jets, it is generally satisfactory to operate the process without supplying heat to the air or jets. When only one jet is used, the node frequency can be undesirably reduced.

Turning first to FIG. 1, which shows a cross-section schematic view of a jet that can be used in the process, it can be seen that continuous filaments 3*a* are fed to yarn slot 4 between jet body 1 and plate 5, and entangled yarn 3*b* emerges in the direction of the arrow. Fluid channel pair 2*a* or fluid channel pair 2*b* directs the entangling fluid medium, typically air, against the yarn. Only one member of each channel pair is shown in FIG. 1. Each fluid channel can have an internal diameter of about 1.4 to 1.7 mm. Only one channel pair is generally present in jet body 1; pairs 2*a* and 2*b* indicate alternative arrangements when the jet is oriented in the 'forward' or 'reverse' direction, respectively. When the jet is used in the forward direction as shown in FIG. 1, channel pair 2*a* directs the air against the yarn in somewhat the same direction as yarn travel. When used in the 'reverse' direction, channel pair 2*b* directs the air against the yarn in somewhat the opposite direction to yarn travel. Each channel pair 2*a* and 2*b* defines imaginary planes 7*a* and 7*b*, respectively. Angles $\gamma$ are between imaginary planes 7*a* or 7*b* and imaginary plane 6, which is perpendicular to yarn slot 4. A positive value of angle $\gamma$ indicates 'forward' orientation, and a negative value indicates 'reverse' orientation. The present process employs jets having values of $\gamma$ of $-5°$ to $-30°$ in order to gain higher node frequency and constancy. Jets having values of $\gamma$ of $-10°$ to $-25°$ are preferred.

Figure 2:
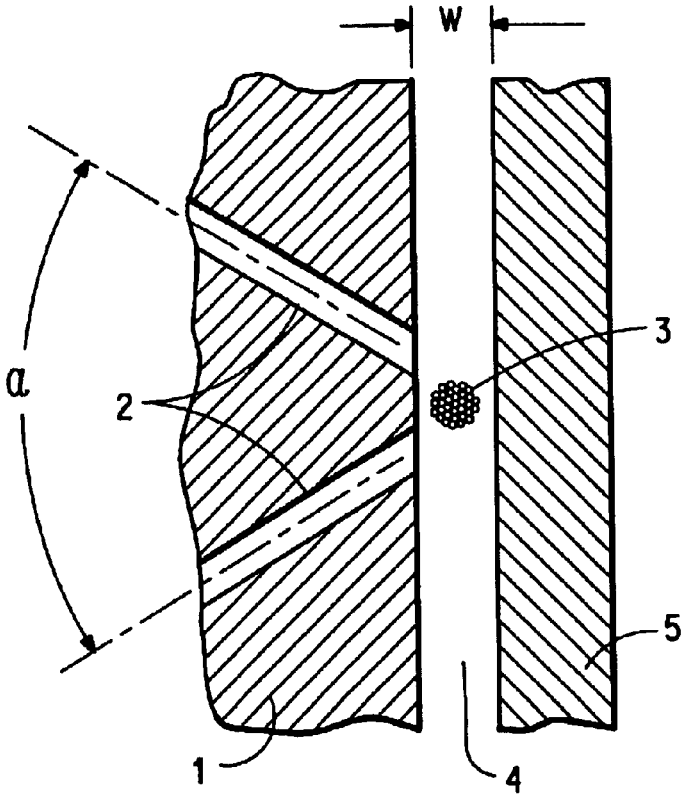
FIG. 2 schematically illustrates a detail of a cross-section of a jet that can be used in the process of the invention.

FIG. 2 shows at right angles to FIG. 1 the relationship among jet body 1, continuous filament yarn 3 (in cross-section), channel pair 2 (which can be either channel pair 2*a* or channel pair 2*b* of FIG. 1), yarn slot 4, and plate 5. Width "w" of yarn slot 4 can be about 1.2 to 2.5 mm. Angle $\alpha$ can be about 80° to 100°.

Figure 3:
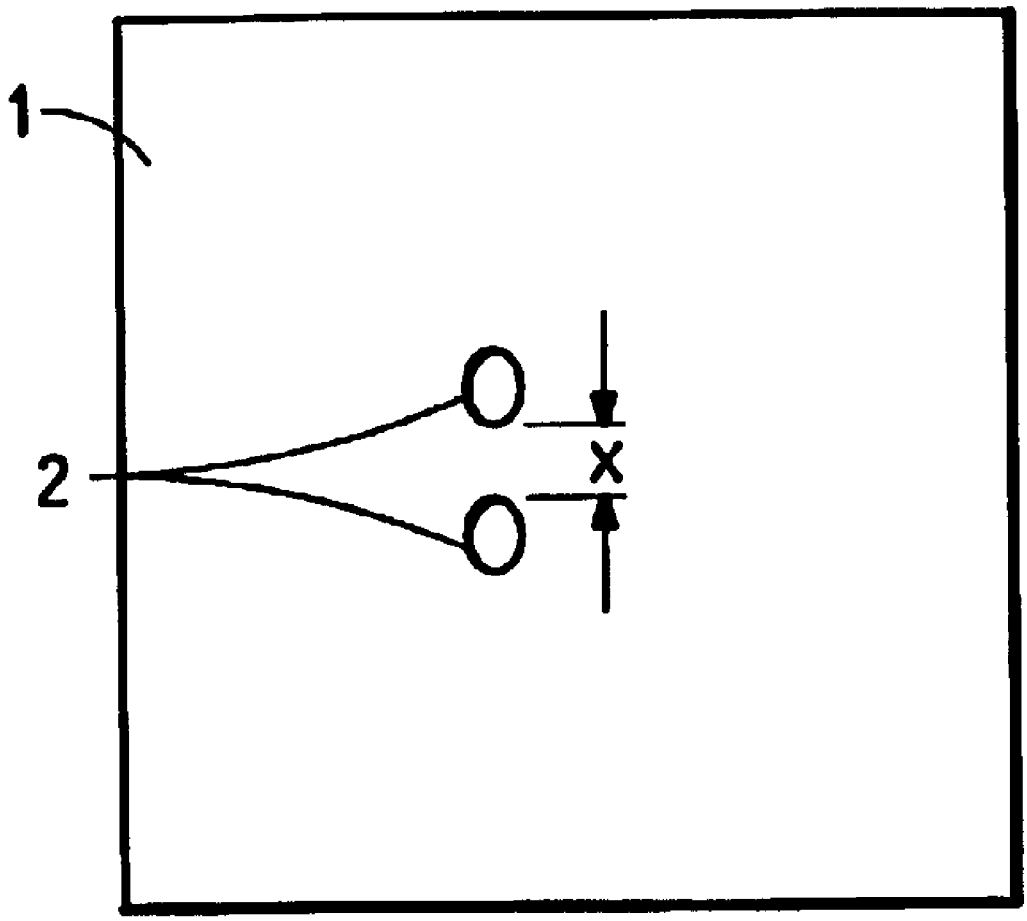
FIG. 3 shows fluid orifices of a jet that can be used in the process of the invention.

FIG. 3 shows that the exit orifices of the members of channel pair 2 as they exit jet body 1 are separated by a distance 'x', which can be about 2.5 to 3.5 mm.

The yarn slot of each jet (see FIGS. 1 and 2) is typically aligned with the axis of the moving yarn for higher node frequency but can optionally be canted slightly off-axis. The jet parts can be of glazed ceramic, for example of alumina, to reduce abrasion of the yarn and to extend the useful life of the jet.

The continuous filaments are supplied to the jet(s) at an overfeed of about 2 to 6%, typically 3% to 5% and can be passed through the jets at a speed of about 1200 to 3000 m/min. The entangling fluid can be air, which can be supplied at a pressure of about 45 to 125 psig (310 to 860 kPa). There is no particular limit to the total decitex of the yarn that is subjected to the process of the invention, which can be about 150 to 1350 dtex. When high decitex yarn is subjected to the process of the invention and when higher filament speeds are used, angle $\gamma$ can be made more negative, and the air pressure supplied to the jets, the yarn slot width, and the air channel diameter can be increased, to attain the desired node frequency and constancy.

A twisting step is unnecessary in the process of the invention, and lack of intentional twist is preferred in order not to add unnecessary expense and to improve downstream processing.

The process can be coupled with fiber spinning or operated separately from fiber spinning, as a split process. A finish can be applied to the filaments before they enter the jets, for example at a level of 0.2 to 1.0 wt %, based on filament weight.

As wound up, the bicomponent fiber made by the present process exhibits some crimp. Full crimp development can be attained under dry heat or wet heat conditions in a substantially relaxed state. For example, dry or wet (steam) heating in a tenter frame and wet heating in a dyebath or jig scour can be effective.

The frequency of entanglement nodes and standard deviation of the interval between nodes in the samples made in the Examples were determined according to ASTM Test Method D4724, using a "Rapid 400" instrument manufactured by Lenzing Technik. In this test, the entanglement level of a multi-filament yarn was determined by an instrument which inserted a wheel-mounted pin into a sample of moving yarn. Nodes were recorded as a tension increase above a preselected level, as detected by a tensiometer. Since the yarns were 300 denier (333 dtex), the trip force was set at the recommended 25 g. Unless otherwise noted, the following instrument settings were used: Match Steps 50, Tension Scan Interval 1, and Tension Response Interval 5. Data was obtained on 2000 node intervals or 100 meters, whichever point was reached sooner.

Crimp Potential ("CP") and Crimp Shrinkage ("CS") were determined by measuring the length of a yarn skein under standard loads before and after dry heat treatment. A 7000 denier (7778 dtex) (measured as doubled), ½-inch wide skein sample was prepared from the yarn to be tested. The skein sample was mounted on the magazine of a textured yarn tester (Texturmat-ME, Lawson Hemphill Sales Co.), and a 700 g (100 mg/d) load was applied for at least 10 seconds. The length of the skein was determined and reported as $L_1$. The sample was removed from the tester, placed in a hot air oven (Lawson Hemphill Sales Co.) held at 121.0±0.2° C. for 5 minutes, removed from the oven, and allowed to cool for 20 minutes. The sample was returned to the textured yarn tester, a 10.5 g (1.5 mg/d) load was applied, and the skein length was recorded as $L_2$. Finally, a 700 g load was applied again, and the length of the skein was determined and recorded as $L_3$. % CP and % CS were calculated from the following formulae:

$$\% CP = \frac{L_3 - L_2}{L_2} \times 100 \quad (1)$$

$$\% CS = \frac{L_1 - L_3}{L_1} \times 100 \quad (2)$$

All the samples in the Examples had Crimp Shrinkage of 7–9%. Since Crimp Contraction % is calculated as 100×($L_3$−L2)/L3, Crimp Potential is related to Crimp Contraction according to the following formula:

$$CP = CC \times L_3/L_2 \quad (3)$$

and empirically by:

$$CP = 2.8 \times CC - 43.9 \quad (4)$$

A Crimp Potential value of 39% is equivalent to a Crimp Contraction value of 30%.

EXAMPLE 1

Continuous filament bicomponent yarns were melt-spun from poly(ethylene terephthalate) (0.54 dl/g IV, Crystar® 4415, a registered trademark of E. I. du Pont de Nemours and Company) and poly(trimethylene terephthalate) (1.02 dl/g IV, Sorona®, a registered trademark of E. I. du Pont de Nemours and Company), subjected to cross-flow quench, withdrawn at 353 ypm (322 m/min), drawn 5.1×, heat-treated at 170° C., and wound up at 1720 yards/min (1575 m/min) with a winding tension of about 0.1 to 0.2 gpd (0.09 to 0.18 dN/tex). The weight ratio of 2G-T to 3G-T was 60:40. The yarns had 68 filaments, a total decitex of 333, and a 'snowman' cross-section.

Samples 2 through 6 were passed through two jets in series. The entangling fluid was air supplied at about 20° C. and 54 psig (372 kilopascal) pressure. The jets were also operated at ambient temperature, that is, about 20° C. The yarn speed at the jets was about 1740 yard/min (1590 m/min), which represented 3.2% overfeed.

With reference to Table I and the jet elements shown in the Figures, all the jets had an angle α of 90°. Jets "X" and "Y" had distances 'x' between the channel exits of 3.15 mm, yarn slot widths "w" of 2.03 mm, and air channel diameters of 1.57 mm. Jet "X" had an angle γ of −15° ('reverse'), and Jet "Y" had an angle γ of +15° ('forward'). Jet "Z" had a distance 'x' between the channel exits of 2.03 mm, a yarn slot width "w" of 1.02 mm width, an air channel diameter of 1.27 mm, and an angle γ of 0°. "Comp." indicates a Comparison Sample, and "std. dev" means standard deviation.

TABLE I

| Sample | First Jet | Second Jet | Nodes/m | Node Interval, std. dev. in cm | CP, % |
|---|---|---|---|---|---|
| 1 (Comp.) | None | None | 1.7 | 35.3 | 75 |
| 2 (Comp.) | Y | Z | 34.2 | 1.5 | 80 |
| 3 (Comp.) | Z | Y | 35.6 | 1.5 | 80 |
| 4 (Comp.) | Z | Z | 36.9 | 1.4 | 71 |
| 5 (Comp.) | Y | Y | 38.2 | 1.2 | 73 |
| 6 | X | X | 42.5 | 1.0 | 70 |

The data in Table I show that, in contrast to the Comparison Samples, Sample 6, made by the process of the invention, had higher node frequency and higher constancy as indicated by low standard deviation of the intervals. Sample 6 also retained very high crimp levels, only about 7% less (relative) than that of the unentangled yarn.

EXAMPLE 2

Continuous bicomponent filaments were melt-spun from poly(ethylene terephthalate) (0.54 dl/g IV, Crystar® 4415, a registered trademark of E. I. du Pont de Nemours and Company) and poly(trimethylene terephthalate) (1.02 dl/g IV, Sorona®, a registered trademark of E. I. du Pont de Nemours and Company), subjected to cross-flow quench, withdrawn at 360 ypm (329 m/min), and simultaneously drawn and heat-treated at 170° C. The weight ratio of 2G-T to 3G-T was 60:40. The yarn had 68 filaments, a total decitex of 333, and a snowman cross-section.

Sample 7A (Comparison) was prepared using the following additional conditions. The draw ratio was 4.4×, and finish was applied at 1.2 wt % based on yarn weight. The yarn was passed through two jets of the type shown in FIGS. 1, 2, and 3 in series between the final draw roll and the let-down roll that preceded the winder. The yarn speed at the jets was about 2430 ypm (2220 m/min), the overfeed at the jet was 2.2%, and the pressure of the air fed to the jets was 60 psig (415 kilopascal). Referring to the Figures, the jets had a yarn slot width "w" of 0.040 inches (1.02 mm), an air channel diameter of 0.050 inches (1.27 mm), an angle γ of 0°, an angle α of 90°, and a distance 'x' between the channel exits of 0.080 inches (2.03 mm). The windup speed was 2390 ypm (2185 m/min). The yarn exhibited 17 nodes/m with a standard deviation of 4.4 cm between nodes, and a Crimp Potential of 68%.

To make Sample 7B, the following additional conditions were used. The draw ratio was 5.0×, and finish was applied at 0.8 to 1% based on yarn weight. Before entangling, the yarn had a Crimp Potential of 65%, and a Crimp Shrinkage of 7%. The yarn was passed through two jets of the type shown in FIGS. 1, 2, and 3 in series. The yarn speed at the jets was about 1740 ypm (1590 m/min), the overfeed was 3.2%, and the pressure of the air fed to the jets was 54 psig (372 kilopascal). The jets had a yarn slot width "w" of 0.080 inches (2.03 mm), an air channel diameter of 0.062 inches (1.57 mm), an angle γ of −15°, an angle α of 90°, and a distance 'x' between the channel exits of 0.124 inches (3.15 mm). The windup speed was 1720 ypm (1575 m/min). The yarn exhibited 40 nodes/meter with a standard deviation of the node interval of 1.1 cm, and a Crimp Potential of 72%.

To determine node frequency and interval constancy in this Example, the following instrument settings were used: Match Steps 0, Tension Scan Interval 7, Tension Response Interval 35. Each sample was tested until 20 nodes were detected. These settings had the effect of reducing the node frequency of Sample 2A by an estimated 1 unit and that of Sample 2B by an estimated 5 units, compared to frequencies that would have been obtained with the instrument settings used in Example 1.

The suitability for weaving of entangled yarns substantially the same as Samples 7A and 7B was tested by making weft-stretch 2×1 twills (denim) on an air-jet loom. The warp was cotton, and entangled yarns were woven pick-and-pick with cotton. Typical weavability results are presented in Table II; loom efficiency was determined at 525 picks/min and calculated as operating hours divided by total hours.

TABLE II

| | Comparison | Invention |
|---|---|---|
| Stops per 100,000 picks | >5 | <1 |
| Efficiency, % (1) | 72 | 92 |
| Speed, picks/min | 525 | up to 780 |

(1) Determined at 525 picks/min

The data in Table II show that weaving with entangled yarns of the invention was significantly better than with comparison yarns, resulting in fewer loom stops, higher loom efficiency, and higher speed.

What is claimed is:

1. An entangled continuous filament yarn comprising at least two bicomponent filaments each comprising poly (trimethylene terephthalate) and poly(ethylene terephthalate), wherein the entangled yarn has a node frequency of about 0 to 50 nodes/m, a Crimp Potential of at least about 40%, substantially no twist, and a standard deviation of intervals between nodes of no more than about 1.1 cm.

2. The yarn of claim 1 wherein the Crimp Potential is about 55 to 160%.

3. The yarn of claim 1 wherein the Crimp Potential is reduced by no more than about 25% relative, compared to filaments in a corresponding unentangled yarn.

4. A process for making an entangled yarn comprising the steps of:

providing at least two bicomponent continuous filaments each comprising poly(trimethylene terephthalate) and poly(ethylene terephthalate) and having a Crimp Potential of at least about 40%, wherein the filaments are selected from the group consisting of fully drawn and fully oriented; and countercurrently contacting said filaments with a fluid at an over feed of about 2 to 6% to entangle the yarn, wherein countercurrently contacting said filaments with a fluid comprises entangling the yarn to have a standard deviation of intervals between nodes of no more than about 1.1 cm.

5. A process for making an entangled yarn comprising the steps of:

providing at least two bicomponent continuous filaments each comprising poly(trimethylene terephthalate) and poly(ethylene terephthalate) and having a Crimp Potential of at least about 40%, wherein the filaments are selected from the group consisting of fully drawn and fully oriented;

providing at least two jets, each jet comprising a yarn slot and two channels for directing air at the filaments wherein longitudinal axes of said channels define a first imaginary plane, wherein an angle γ between the first imaginary plane and a second imaginary plane perpendicular to the yarn slot is about −5° to −30°; and passing the filaments through the jets in series at an overfeed of about 2 to 6% to entangle the yarn.

6. The process of claim 5 wherein the filaments are passed through the jets at a speed of about 1200 to 3000 m/min and each jet is provided with air at a pressure of about 310 to 860 kPa.

7. The process of claim 5 wherein the Crimp Potential of the filaments is reduced by no more than about 25% relative, compared to filaments in a corresponding unentangled yarn.

8. The process of claim 5 wherein the jets have a yarn slot width of about 1.2 to 2.5 mm.

9. The process of claim 8 wherein the jets have an angle γ between the channels of about 80 to 100°, a distance between orifices of the channels of about 2.5 to 3.5 mm, and a channel diameter of about 1.4 to 1.7 mm.

10. An entangled yarn made by the process of claim 4.

11. A fabric comprising the yarn of claim 10.

12. The process of claim 4, wherein countercurrently contacting said filaments with a fluid further comprises:

entangling the yarn to have a node frequency of about 40 to 50 nodes/m.

13. The process of claim 4, wherein currently contacting said filaments with a fluid further comprises:

entangling the yarn to have a Crimp Potential which is reduced by no more than about 25% relative compared to filaments in a corresponding unentangled yarn.

14. An entangled yarn made by the process of claim 5.

15. A fabric comprising the yarn of claim 14.

* * * * *